US006095641A

United States Patent [19]

Kishi

[11] Patent Number: 6,095,641

[45] Date of Patent: Aug. 1, 2000

[54] SIMPLIFIED INK JET RECORDING HEAD AND A MANUFACTURING METHOD THEREOF

[75] Inventor: Motoshi Kishi, Nagoya, Japan

[73] Assignee: Brother Kogyo Kabushiki Kaisha, Nagoya, Japan

[21] Appl. No.: 08/964,276

[22] Filed: Nov. 4, 1997

[30] Foreign Application Priority Data

Nov. 19, 1996 [JP] Japan ..... 8-324649

[51] Int. Cl.[7] ..... B41J 2/045

[52] U.S. Cl. ..... 347/71; 29/890.1

[58] Field of Search ..... 347/68, 69, 70, 347/71, 72; 29/890.1

[56] References Cited

U.S. PATENT DOCUMENTS

| | | | |
|---|---|---|---|
| 4,819,014 | 4/1989 | Yasuhara et al. | 347/68 |
| 5,754,203 | 5/1998 | Kinoshita | 347/69 |
| 5,818,483 | 10/1998 | Mizutani | 347/72 |
| 5,872,580 | 2/1999 | Ochi et al. | 347/71 X |

FOREIGN PATENT DOCUMENTS

| | | |
|---|---|---|
| 4-290749 | 10/1992 | Japan . |
| 6-8432 | 1/1994 | Japan . |
| 7-081048 | 3/1995 | Japan . |
| 7-304168 | 11/1995 | Japan . |
| WO-92/22429 | 12/1992 | WIPO . |

*Primary Examiner*—Fred L. Braun
*Attorney, Agent, or Firm*—Oliff & Berridge, PLC

[57] ABSTRACT

An improved ink jet head for use with a drive circuit that includes a plurality of actuator units, each of the plurality of actuator units has a base plate defining a plurality of ink chambers on a first surface, a cover plate disposed on the base plate to cover the plurality of ink chambers, a plurality of drive electrodes formed on side surfaces of each of the ink chambers, a plurality of extended electrodes extending from the side surfaces which are formed on the second surface of the base plate, and a plurality of connecting electrodes, disposed on the cover plate, that connect the electrodes and the drive circuit. The extended electrodes formed on the top of the base plate on the first actuator are connected to the plurality of connecting electrodes disposed on the cover plate on the second actuator. The actuator units are capable of forming a multi-layered ink jet print head by stacking the plurality of actuator units one upon the other in a simple and efficient manner.

21 Claims, 13 Drawing Sheets

SIMPLIFIED INK JET RECORDING HEAD AND A MANUFACTURING METHOD THEREOF

BACKGROUND OF THE INVENTION

1. Field of Invention

The invention relates to an ink jet head for performing a recording operation on a recording medium by jetting ink droplets from nozzles via energy generated by energy generating elements. Particularly, the invention relates to an ink jet head for performing a recording operation on a recording medium by jetting ink disposed in ink chambers from nozzles that communicate with the ink chambers by displacing piezoelectric elements through selectively applying drive voltages to the piezoelectric elements.

2. Description of Related Art

A conventional structure of an input unit for transmitting voltage applying signals for displacing piezoelectric elements to electrodes formed in ink chambers is disclosed in U.S. Pat. No. 5,598,196.

As shown in FIGS. 12 and 13, a cover plate 424 is provided on a piezoelectric body 412 to cover a plurality of ink channels formed in the piezoelectric body 412. Electrodes 422 are formed on side surfaces of the ink channels 416 and electrical conductors 426 are formed on a rear surface (a surface facing the ink channels) of the cover plate 424 at positions corresponding to the ink channels 416. Further, the electrical conductors 426 formed on the rear surface of the cover plate 424 and the electrodes 422 formed on the side surfaces of the ink channels 416 at positions corresponding to the electrical conductors 426, are connected to each other. As shown in FIG. 13, the cover plate 424 and the electrical conductors 426 formed on the rear surface of the cover plate 424, project from an end surface of the piezoelectric body 412 at an end surface opposite to the end where a nozzle plate 430 is provided. A pattern of electrical contact pads 438 is formed on the electrical conductors 426 at the end portions thereof.

However, according to the above-described structure, the electrical conductors 426 must be formed on the rear surface of the cover plate 424 before the cover plate 424 can be arranged on the piezoelectric body 412. However, when the cover plate 424 is arranged on the piezoelectric body 412, it is very difficult to accurately form the electrical conductors 426 on the cover plate 424 such that the electrical conductors 426 are brought into contact with the electrodes 422 provided on the side surfaces of the ink channels 416, which reduces manufacturing efficiency. Also, it is very difficult to accurately arrange the cover plate 424 on the piezoelectric body 412 such that the electrical conductors 426 formed on the rear surface of the cover plate 424 are brought into contact with the electrodes 422 provided on the side surfaces of the ink channels 416 corresponding to the electric conductors 426.

Further, according to the above-described structure, the electrical conductors 426 provided on the cover plate 424 face the ink channels 416 in an exposed state. Therefore, the electrical conductors 426 are always in contact with ink disposed in the ink channels 416. Therefore, the electrical conductors 426 are corroded by ink so that the voltage applying signals cannot be firmly transmitted to the electrodes 422 which are connected to the electrical conductors 426, which prevents the jetting of ink.

SUMMARY OF THE INVENTION

Another structure of an input unit for transmitting voltage applying signals to electrodes formed in the ink chambers for displacing piezoelectric elements is explained below.

Conventional ink jet heads are used for a color ink jet printer capable of performing color printing by selectively jetting inks of four colors, including yellow, magenta, cyan and black.

Ink jet heads are shown in FIG. 11 which jet ink droplets by pressurizing ink in ink chambers through displacing a piezoelectric element. As shown in FIG. 11, an ink jet head 300 includes a total of four ink jet heads, e.g., a head for yellow ink 320 for jetting yellow ink, a head for magenta ink 330 for jetting magenta ink, a head for cyan ink 340 for jetting cyan ink and a head for black ink 350 for jetting black ink.

A nozzle plate 302, in which two columns of multiple nozzles for jetting ink droplets are parallel with each other in a vertical direction, is attached at a front surface of the head for black ink 350. Multiple head electrodes 303 and 304 are formed in the vertical direction at the rear portions of two side surfaces of the head for black ink 350. FPC 306 (flexible printed circuit) for electrically connecting the heads to driver IC chips 314 and 315 (integrated circuit), is provided with a horizontal member 311 formed in an elongated plate shape. Vertical members 307 and 308, each having a section in an L-like shape, are formed in the vertical direction from front ends of the horizontal member 311 in the longitudinal direction. A plurality of electrodes 310 for electrically connecting FPC 306 with a driver IC chip mounting base 316, are formed in the longitudinal direction on a rear upper surface of the horizontal member 311 in the longitudinal direction. Further, a plurality of electrodes 309 are formed in the vertical direction for electrically connecting FPC 306. Head electrodes 303 and 304 are formed on surfaces in an L-like shape of the vertical members 307 and 308, which are opposed to each other.

An electrode 312 for electrically connecting to the electrode 310 of FPC 306 is formed at the front end of the rear surface of the driver IC chip mounting base 316 in the longitudinal direction. An electrode 313 for connecting the driver IC chips 314 and 315 to a control circuit is formed at the rear end of the surface of the driver IC chip mounting base 316.

Further, the head for yellow ink 320, the head for magenta ink 330 and the head for cyan ink 340, are provided with a structure which is the same as that of the head for black ink 350.

The driver IC chips 314 and 315 output drive signals to the respective head electrodes 303 and 304 when control signals outputted from the control circuit are inputted thereto. The piezoelectric elements are displaced by voltages of the outputted drive signals, ink in ink chambers is pressurized by the displacement and an ink droplet is jetted from the plurality of nozzles 301, thereby performing a recording operation on a record medium.

However, according to the above-described ink jet head, the vertical chambers 307 and 308 of FPC 306 are interposed between the side surfaces of the respective heads. Therefore, extraneous spaces are needed among the respective heads. Further, FPCs 306 are interposed between the heads and the driver IC chip mounting base 316 for connecting the head electrodes 303 and 304 of the heads with the driver IC chips 314 and 315. Therefore, extraneous spaces are needed. According to such a structure, the respective heads cannot be integrated and extraneous spaces are required, which limits miniaturization of the ink jet head 300.

Furthermore, when the electrodes 310 for FPCs 306 which are connected to the four heads, are connected to the electrode 312 of the driver IC chip mounting base 316, front surfaces of the nozzle plates 302 of the respective heads must be positioned so that the front surfaces of the nozzle plates 302 are on the same plane.

However, the positioning of the nozzle plates 302 is very delicate and cannot be performed easily. Therefore, it takes time to position the nozzle plates 302 precisely which reduces the manufacturing efficiency of the ink jet head.

It is therefore an object of the invention to miniaturize and increase manufacturing efficiency of an ink jet head.

According to a first aspect of the invention, an ink jet head includes a plurality of actuator units. The actuator units include at least a first actuator unit and a second actuator unit which are laminated. The actuator units include a base plate housing a plurality of ink chambers, a cover plate arranged on the base plate to cover the plurality of ink chambers, a plurality of drive electrodes formed on side surfaces of the plurality of ink chambers, a plurality of extended electrodes which extend from the drive electrodes and are formed on a first surface of the base plate opposite to a second surface thereof where the plurality of ink chambers are provided, and a plurality of connecting electrodes arranged on the cover plate for connecting the extended electrodes and a drive circuit. The extended electrodes formed on the base plate of the first actuator unit and the connecting electrodes arranged on the cover plate of the second actuator unit are connected with each other.

A second aspect of the invention includes the ink jet head of the first aspect, and further includes a projected portion which extends from the cover plate and projects from an end surface of the base plate. The plurality of connecting electrodes extend onto the projected portion, and the connecting electrodes are formed on the projected portion and the plurality of connecting electrodes are connected to the drive circuit arranged on the projected portion.

A third aspect of the invention includes the ink jet head of the second aspect wherein the cover plate includes a ceramic substrate.

A fourth aspect of the invention includes the ink jet head of the second aspect, and further includes one sheet of a nozzle plate having a plurality of nozzle holes at positions corresponding to end portions of the respective ink chambers and attached to an end surface of the head integrated with the plurality of actuator units.

A fifth aspect of the invention includes the ink jet head of the first aspect, wherein the base plate includes a piezoelectric element.

According to the first through fifth aspects of the invention, the actuator units are laminated such that the extended electrodes formed on the surface of the base plate of the first actuator unit opposite to the surface where the ink chambers are provided, and the connecting electrodes arranged on the cover plate of the second actuator unit, are connected to each other.

According to the above-described structure, the extended electrodes for connecting the respective drive electrodes with the connecting electrodes can be formed easily by utilizing the bottom surface of the base plate and the upper surface of the cover plate.

That is, if electrodes extended onto an upper surface (a surface where the ink chambers are formed) of a base plate of one actuator unit, and connecting electrodes formed on a bottom surface (a surface facing the ink chambers) of a cover plate of the same actuator unit, are connected with each other, the following problems occur. Since ink chambers are opened at the upper surface of the base plate, if the electrodes are extended onto the upper surface of the base plate, the extending pattern and the extending direction of the electrodes are restricted.

However, according to the structure of the invention where the electrodes are extended onto the lower surface (a surface opposite to the surface where the ink chambers are formed) of the base plate and the electrodes extended onto the lower surface of the base plate are connected to the connecting electrodes provided on an upper surface (a surface opposite to a surface facing the ink chambers) of the cover plate of the contiguous actuator unit, the electrodes formed on the lower surface of the base plate are spaced from the ink chambers, which solves the above-described problem.

Further, the plurality of actuator units are integrally assembled by alternately laminating the base plates and the cover plates in a direction orthogonal to a direction of arranging the ink chambers by aligning directions of the base plates and the cover plates.

By laminating the respective actuator units via aligning the front ends of the respective actuator units that have the nozzle holes, the nozzle surface of the ink jet head can be made flush with high accuracy, which obviates time and labor for positioning the respective actuator units on a driver IC chip mounting base.

Accordingly, manufacturing efficiency of the ink jet head is promoted.

Further, the respective actuator units can be integrated. Therefore, as mentioned in the fourth aspect of the invention, one sheet of a nozzle plate that has nozzle holes at positions corresponding to end portions of the respective ink chambers is attached to the end surface of the head where the plurality of actuator units are integrated. As a result, it is not necessary to attach a nozzle plate to each of the actuator units or to attach a nozzle plate to each of the heads. Further, a plurality of nozzle plates are not necessary. Therefore, a nozzle plate that includes only a single sheet can be used for a plurality of actuator units.

Accordingly, manufacturing efficiency of an ink jet head is further promoted.

Further, as mentioned in the second aspect of the invention, the projected portion that extends from the cover plate and projects from an end surface of the base plate, and the connecting electrodes for conducting electricity between the drive electrodes and the extended electrodes, are provided on the projected portion. Further, the connecting electrodes are connected to a drive circuit which is provided on the projected portion, and the connecting electrodes are connected to the extended electrodes. The drive circuit selectively applies drive voltages to the drive electrodes through the connecting electrodes and the extended electrodes.

The respective drive electrodes are connected to the drive circuit through the extended electrodes and the connecting electrodes on the projected portion, instead of on a surface where the cover plates and the base plates are brought into the contact with each other. Therefore, the contiguous actuator units can be integrated by laminating them.

Therefore, no FPCs for connecting the drive electrodes and the drive circuit are interposed among the actuator units. Thus, the size of the ink jet head in the laminating direction can be reduced.

Further, since the drive circuit which controls the first actuator unit is arranged on the projected portion formed on the cover plate of the second actuator unit contiguous to the first actuator unit, the electrodes for connecting the respective drive electrodes with the drive circuit can be formed easily by utilizing the bottom surfaces of the base plates and the upper surfaces of the cover plates (projected portion).

Further, as mentioned in the third aspect of the invention, since the cover plate includes a ceramic substrate, the actuator unit has sufficient rigidity and ink corrosion resistance. Further, forming the electrodes on the projected portions and mounting the drive circuits is facilitated.

BRIEF DESCRIPTION OF THE DRAWINGS

A preferred embodiment of the invention will be described in detail with reference to the following figures wherein.

DETAILED DESCRIPTION OF PREFERRED EMBODIMENTS

An explanation will be given of an ink jet head according to an embodiment of the invention with reference to the drawings as follows.

Figure 1:
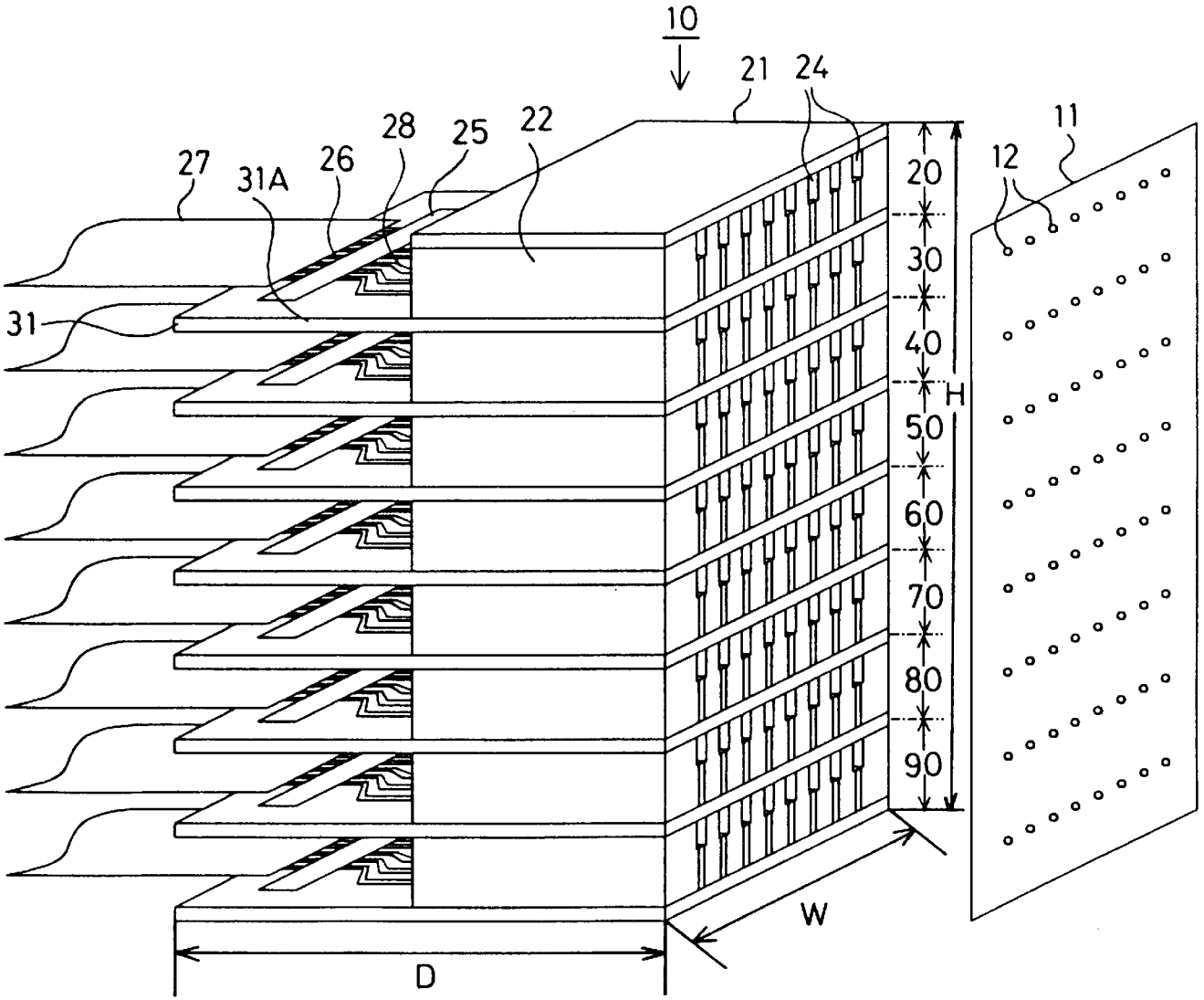
FIG. 1 is a perspective view showing the structure of an ink jet head according to an embodiment of the invention.
Figure 2:
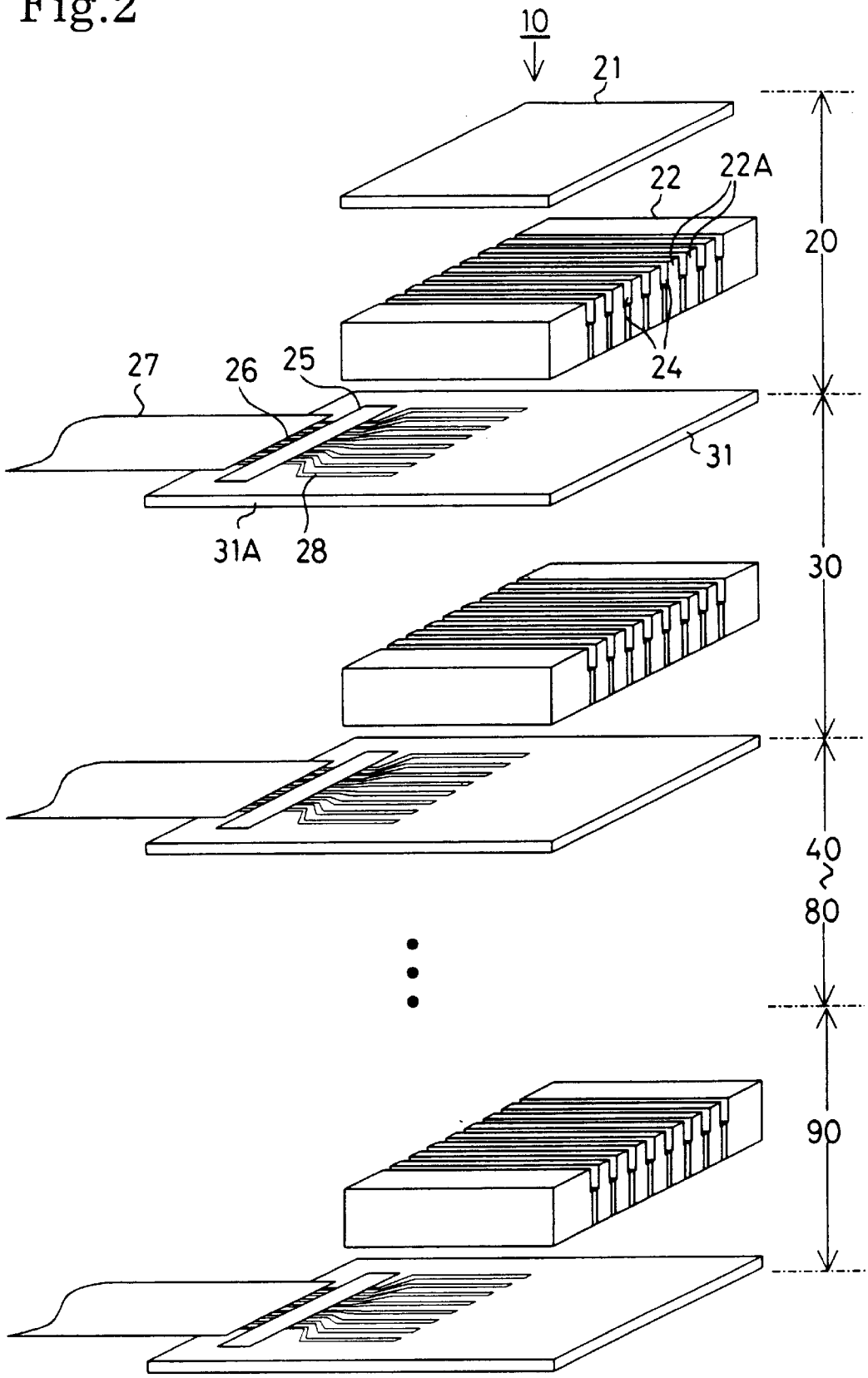
FIG. 2 is an exploded perspective view showing actuator units of an ink jet head shown in FIG. 1.
Figure 3:
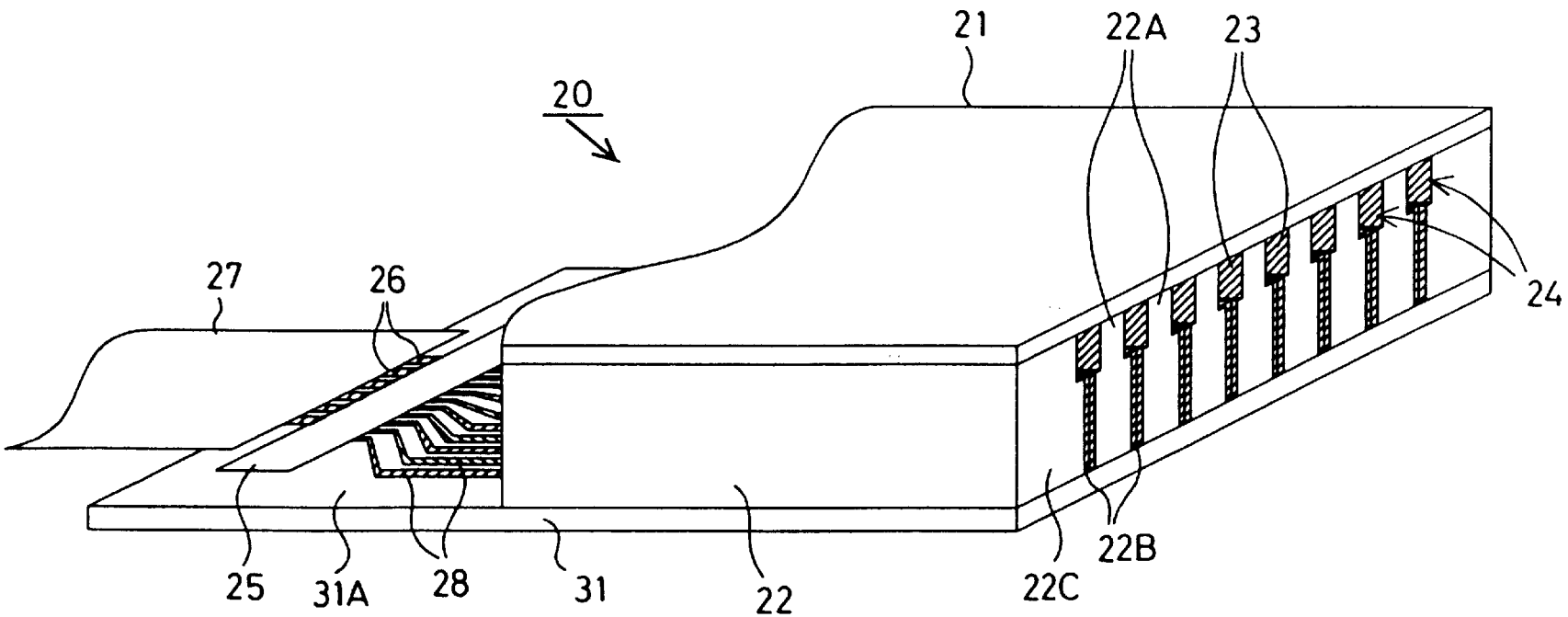
FIG. 3 is a perspective view of an actuator unit shown in FIG. 1.
Figure 4:
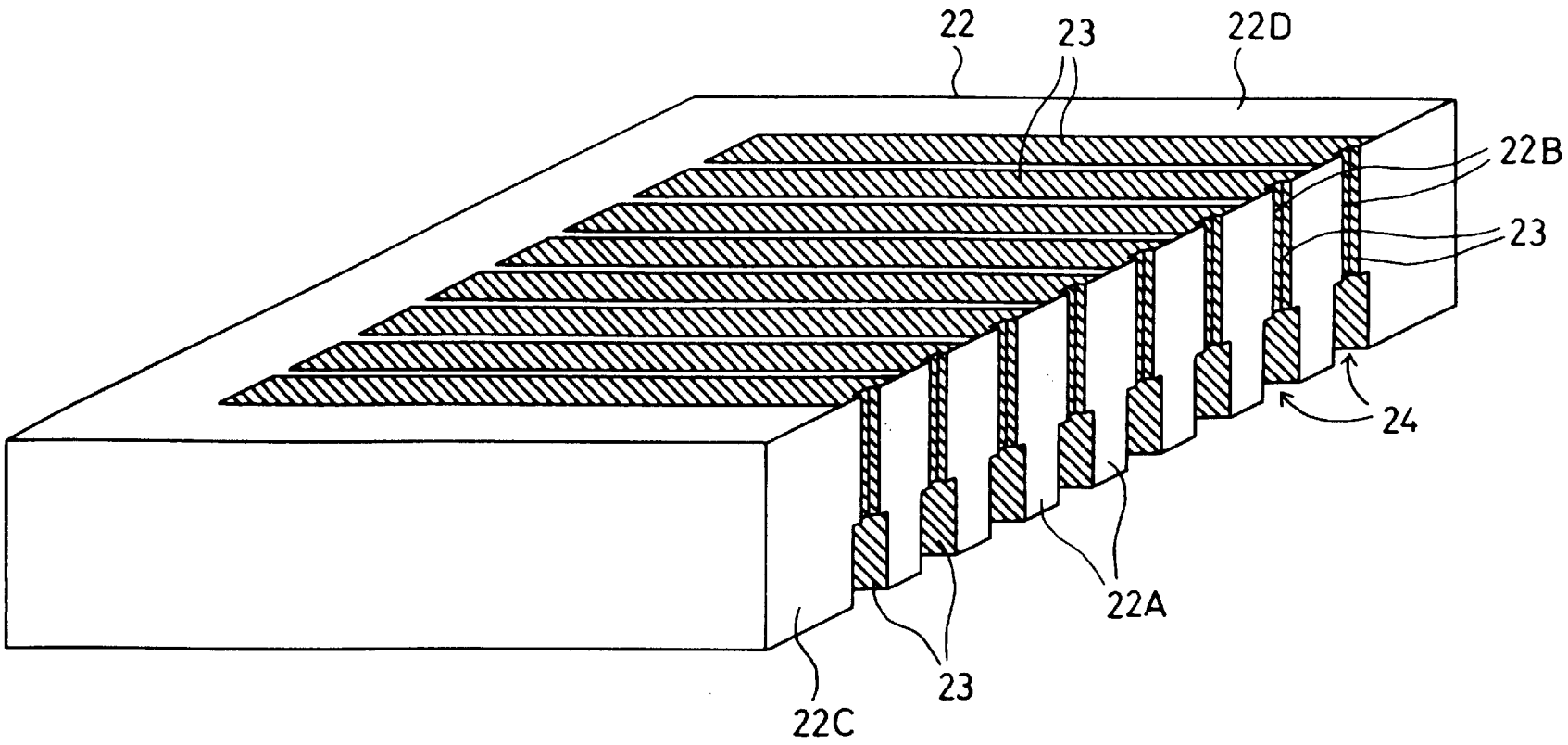
FIG. 4 is a perspective view of a bottom surface of a base plate of the actuator unit shown in FIG. 3.
Figure 5:
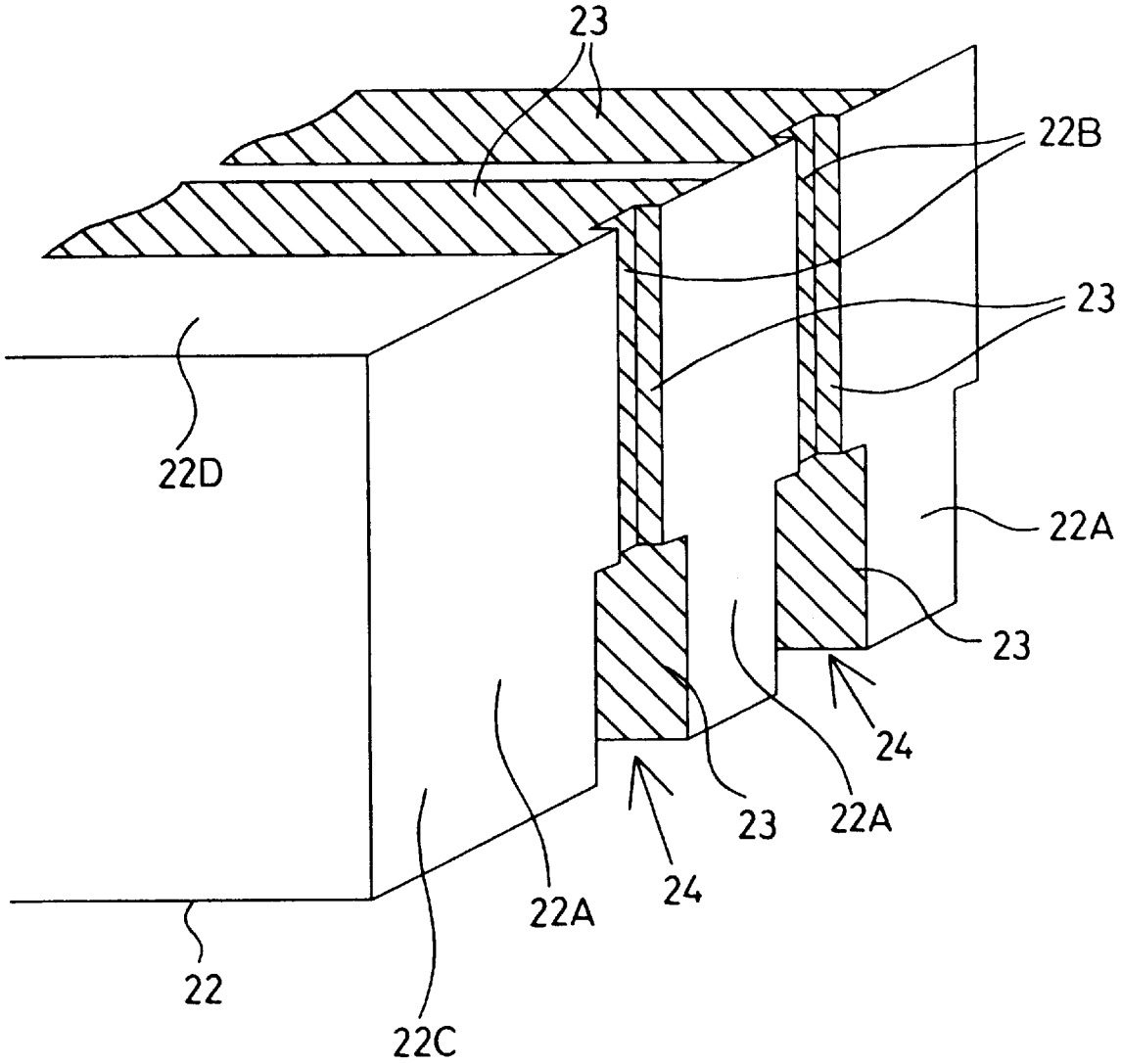
FIG. 5 is a partial perspective view showing a lower surface of the base plate shown in FIG. 4.
Figure 6:
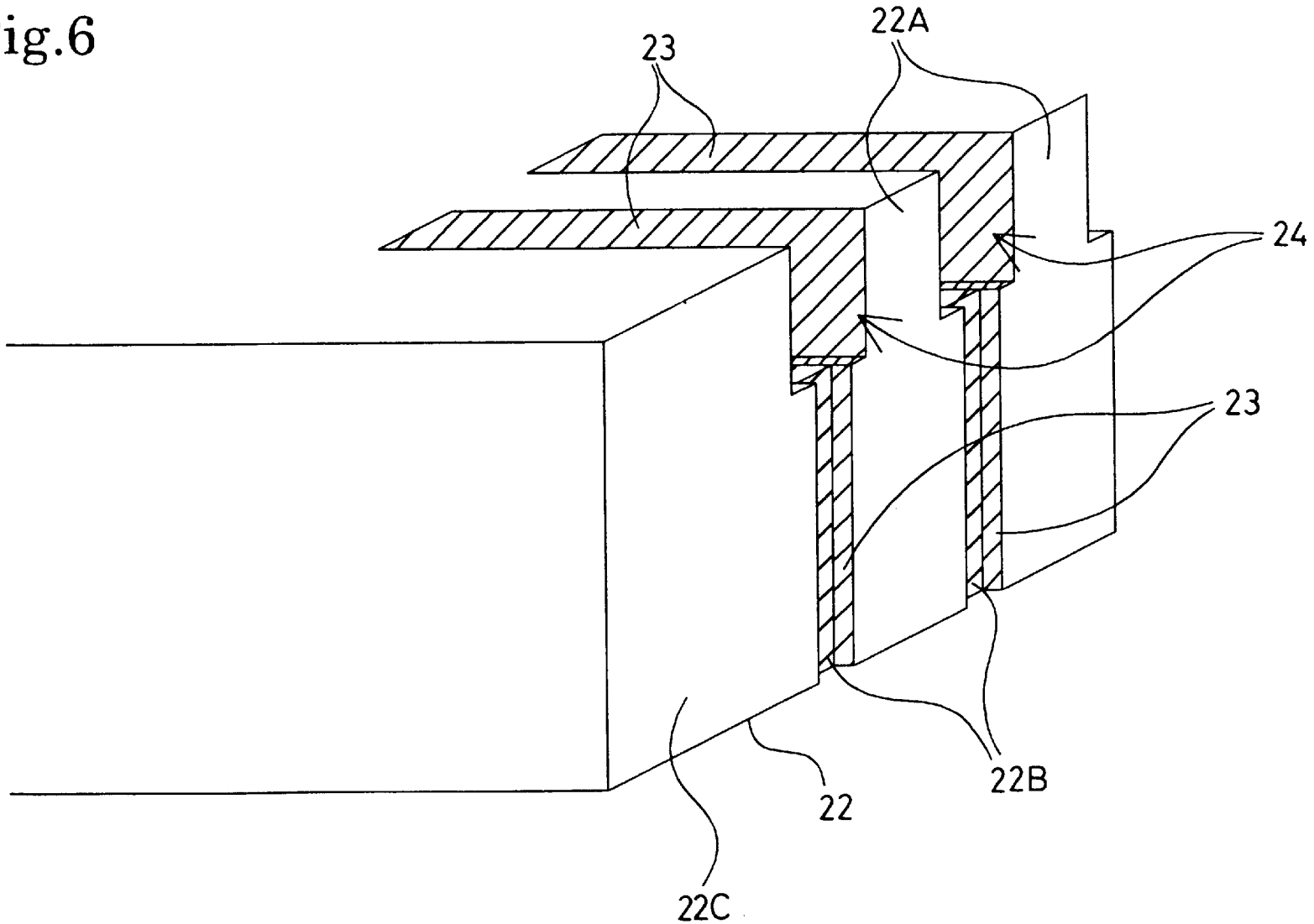
FIG. 6 is a partial perspective view showing an upper surface of the base plate shown in FIG. 5.
Figure 7:
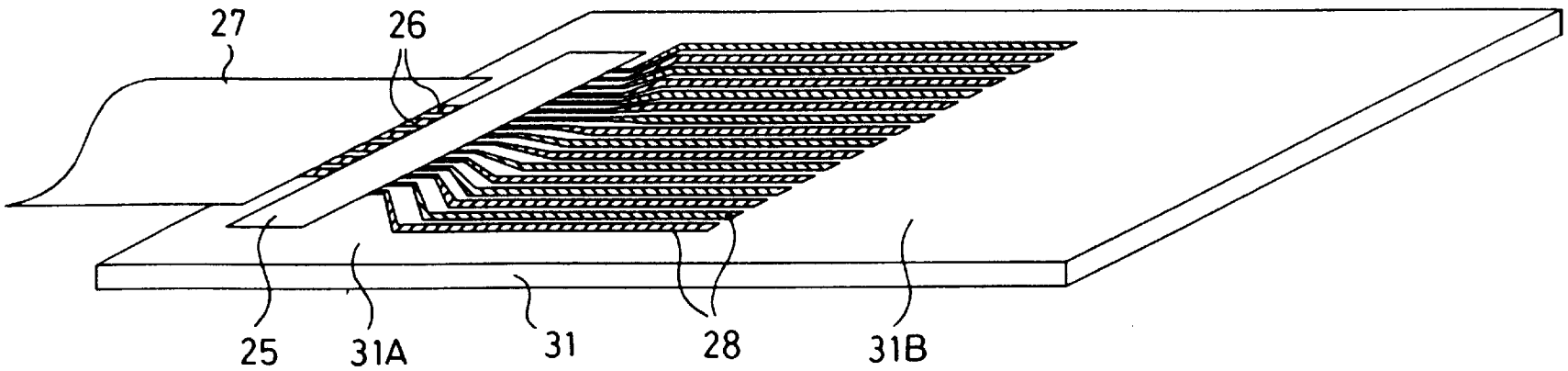
FIG. 7 is a perspective view of a cover plate of an actuator unit shown in FIG. 2.

FIG. 1 is a perspective view showing the structure of an ink jet head according to an embodiment of the invention. FIG. 2 is an exploded perspective view showing actuator units of an ink jet head 10 shown in FIG. 1. FIG. 3 is a perspective view of an actuator unit 20 shown in FIG. 1. FIG. 4 is a perspective view showing a bottom surface of a base plate 22 of the actuator unit 20 shown in FIG. 3. FIG. 5 is a partial perspective view showing a lower face of a base plate 22 shown in FIG. 4. FIG. 6 is a partial perspective view showing an upper surface of a base plate 22 shown in FIG. 5. FIG. 7 is a perspective view of a cover plate 31 of an actuator unit 30 shown in FIG. 2.

Further, according to embodiments of the invention described below, an explanation will be given of an ink jet head (hereinafter, referred to as head) used in a color ink jet printer that performs color printing with inks of four colors, including yellow, magenta, cyan and black. Incidentally, in the following explanation, "front" indicates a direction where a nozzle plate is attached, and "rear" indicates a direction spaced from a nozzle plate.

As shown by FIG. 1, a head 10 is provided with actuator units 20 through 90, and the actuator units 20 through 90 are integrated by being laminated with an adhesive agent. A head for yellow ink includes actuator units 20 and 30 and a head for magenta ink includes actuator units 40 and 50. Further, a head for cyan ink includes actuator units 60 and 70 and a head for black ink includes actuator units 80 and 90.

Next, an explanation will be given of the structure of the actuator unit.

Incidentally, the respective actuator units have the same structure. Therefore, an explanation is only provided with respect to the actuator units 20 and 30 of the head for yellow ink.

As shown in FIGS. 2 and 3, the actuator unit 20 is provided with the base plate 22 that includes piezoelectric elements where a plurality of ink chambers 24, each having a channel-like shape, are formed. A cover plate 21 covering the respective ink chambers 24 is adhered onto an upper surface of the base plate 22, and a cover plate 31 of the actuator unit 30 which is contiguous with the actuator unit 20 is adhered to a bottom surface thereof.

As shown in FIG. 3, separating walls 22A, each having a piezoelectric element integrally formed with the base plate 22, are respectively formed among the ink chambers 24. As shown in FIG. 6, drive electrodes 23 for applying drive voltages to the separating walls 22A are formed respectively on opposing facing wall surfaces and bottom surfaces of the respective ink chambers 24. The drive electrodes 23 are respectively led out to grooves 22B formed at a nozzle plate attaching surface 22C. Further, the led-out drive electrodes 23 are respectively led out to a bottom surface 22D of the base plate 22, as shown in FIGS. 4 and 5. Also, as shown in FIG. 4, the led-out drive electrodes 23 are extended along the bottom surface 22D to a vicinity of a rear end of the bottom surface 22D.

As shown in FIG. 5, each drive electrode 23 formed at the bottom surface 22D has a width extending from an approximate center portion of one separating wall 22A to an approximate center portion of another adjacent separating wall 22A such that one ink chamber 24 is sandwiched therebetween. That is, each drive electrode 23 formed at the bottom surface 22D of the base plate 22 has a width approximately equal to the width of an ink chamber 24 plus the width of one separating wall 22A.

Figure 12:
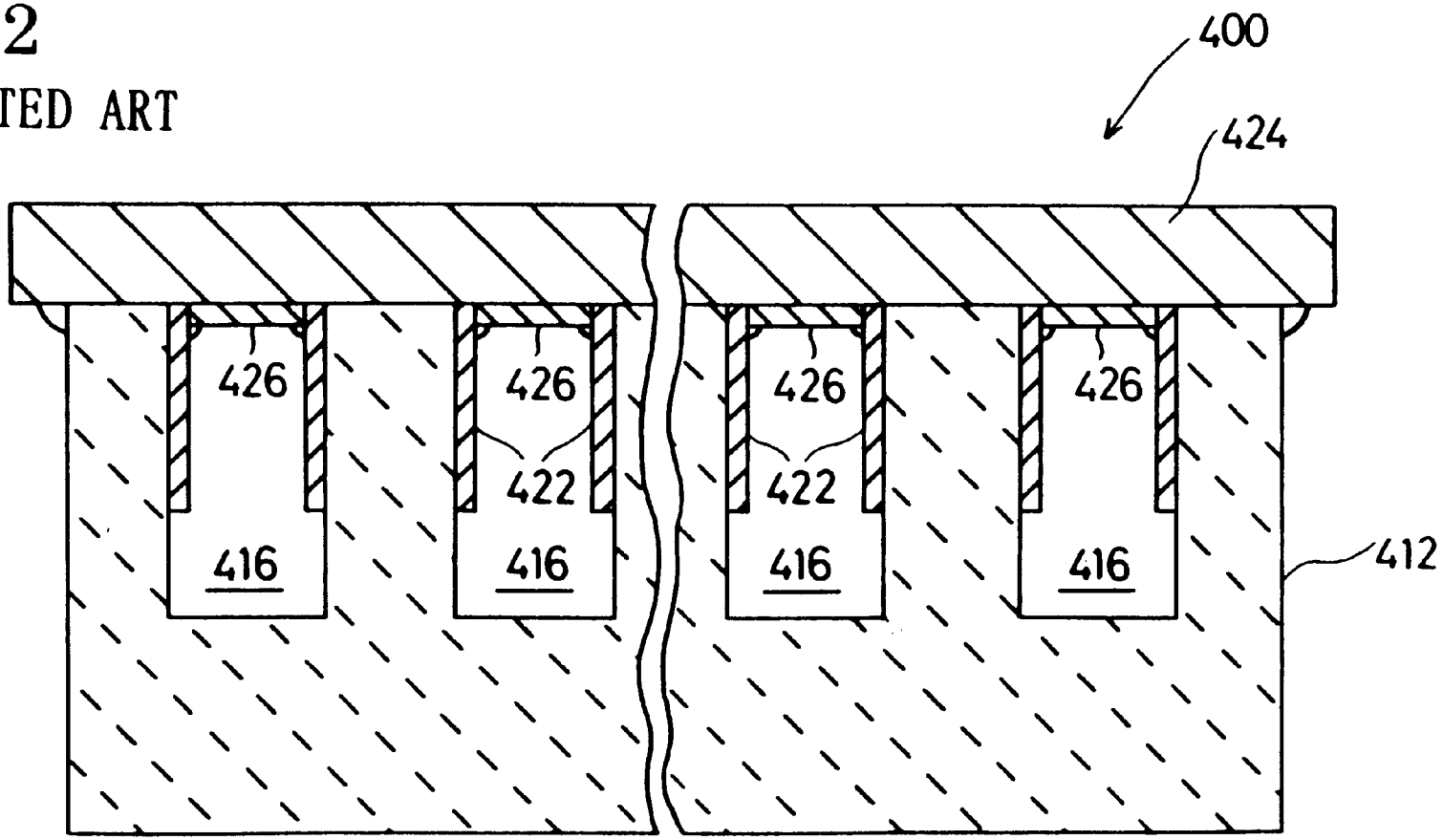
Fig.12 RELATED ART
FIG. 12 is a sectional view of a head in accordance with the related art.
Figure 13:
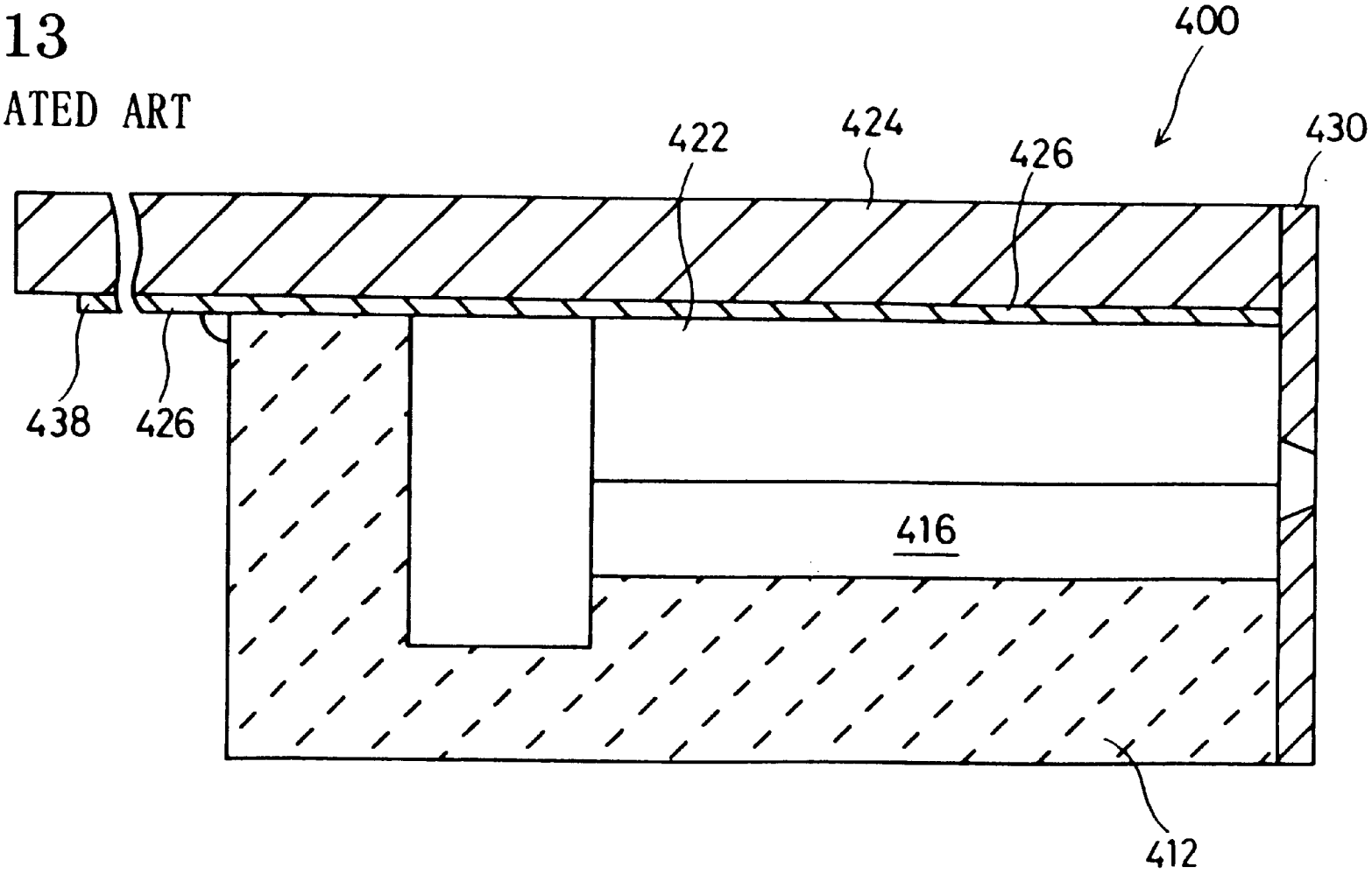
Fig.13 RELATED ART
FIG. 13 is a sectional view of the head of FIG. 12 in accordance with the related art.

Compared to an electrical conductor that has a width substantially equal to that of an ink channel of the conventional device, the drive electrode formed at the bottom surface 22D of the base plate 22 of the device according to the embodiment of the invention, has a considerably wide width. For example, assume that the ink chamber and the separating wall have substantially the same width (about 85 micrometers to 100 micrometers), the drive electrode formed at the bottom surface 22D of the base plate 22 according to the embodiment of the invention, can have a width twice as large as that of the electrical conductor that has a width substantially equal to the width of an ink chamber formed at a rear surface of the cover plate of the conventional device as shown in FIGS. 12 and 13.

As shown by FIG. 7, a projected portion 31A is formed on a rear side of an upper surface 31B of the cover plate 31, specifically, the surface of the cover plate 31 in contact with the bottom surface 22D of the base plate 22. The projected portion 31A projects rearwardly from an adhered surface when the upper surface 31B of the cover plate 31 is adhered to the bottom surface 22D of the base plate 22. A driver IC chip 25 a that has a drive circuit for applying a drive voltage on the drive electrode 23, is attached onto the upper surface of the projected portion 31A. Output side electrodes 28 that are electrically connected to the drive electrodes 23 are formed in a pattern at the front end of the driver IC chip 25 in the longitudinal direction, and input side electrodes 26 are formed in a pattern at the rear end of the driver IC chip 25 in the longitudinal direction.

In this way, the drive electrodes 23 and the output side electrodes 28 are respectively formed at positions electrically connected to each other when the bottom surface 22D of the base plate 22 is adhered to the upper surface 31B of the cover plate 31.

Accordingly, the drive electrodes 23 and the output side electrodes 28 can be electrically connected to each other by adhering the bottom surface 22D of the base plate 22 onto the upper surface 31B of the cover plate 31. Thereby, the drive electrodes 23 of the actuator unit 20 can be electrically connected to the output side of the driver IC chip 25 attached to the projected portion 31A of the cover plate 31. As mentioned above, the drive electrodes 23 formed at the bottom surface 22D of the base plate 22 according to the embodiment of the invention, have a width approximately equal to the width of an ink chamber 24 plus the width of one separating wall 22A. Therefore, the drive electrodes 23 can be formed on the bottom surface 22D with a wide width. Therefore, for example, the actuators 20 and 30 can easily be laminated such that the drive electrodes 23 formed at the bottom surface 22D of the actuator 20 are accurately connected to the output side electrodes 28 formed on the cover plate 31 of the contiguous actuator 30.

According to such a structure, the drive electrode 23 of the actuator unit 20 can electrically be connected to the driver IC chip 25 for outputting drive signals to the drive electrodes 23 by using the projected portion 31A of the cover plate 31 of the actuator unit 30.

Incidentally, according to the embodiment of the invention, the drive electrodes 23 are formed by plating or performing metal vapor deposition after masking portions where the drive electrodes 23 are not formed, or forming an outline of electrodes at locations including portions for forming the drive electrodes 23 and thereafter patterning the portions with a laser beam. Also, the cover plate 31 is formed of a ceramic substrate.

Figure 8:
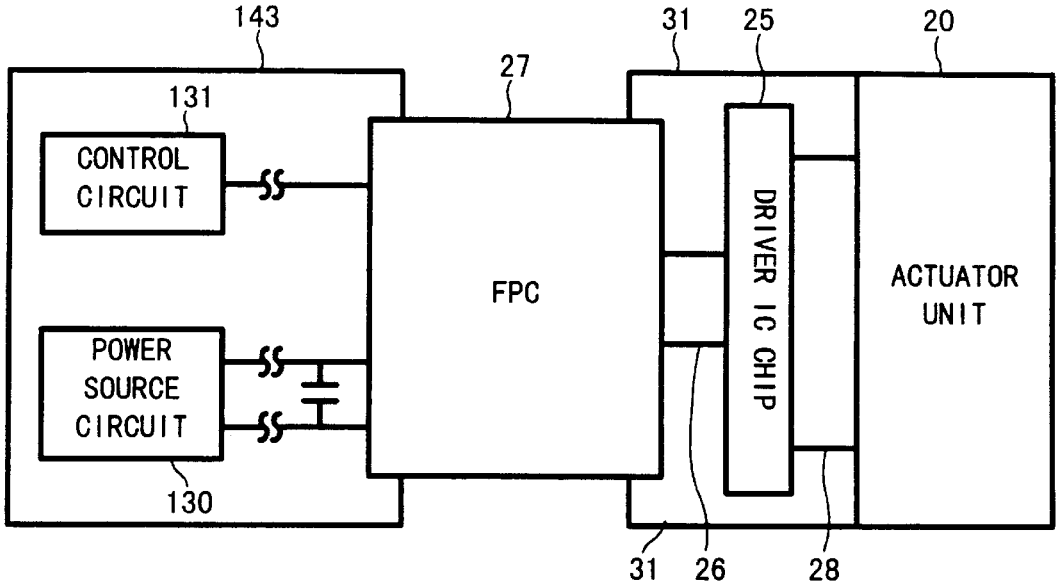
FIG. 8 is a block diagram showing the connections between the actuator unit and a control circuit.

Next, an explanation will be given of the connections between the actuator unit 20 and a control circuit with reference to FIG. 8 which shows this relationship via a block diagram.

The input side electrodes 26 of the driver IC chip 25 are electrically connected to FPC 27. FPC 27 is electrically connected to a control circuit 131 and a power source circuit 130 mounted on a control base 143.

Further, a drive voltage is supplied to the driver IC chip 25 from the power source circuit 130 via FPC 27. A control signal is outputted from the control circuit 131 to the driver IC chip 25 via FPC 27. Successively, the driver IC chip 25 outputs a drive signal to the actuator unit 20 in accordance with the inputted control signal such that the actuator unit 20 is driven.

Incidentally, the other actuator units 30 through 90 have the same structure as that of the actuator unit 20. As shown in FIG. 1, one sheet of a nozzle plate 11 is adhered to front surfaces of the actuator units 20 through 90 which are integrated by laminating them. A plurality of nozzle holes 12, for jetting ink disposed in pressurized ink chambers as ink droplets, are formed at the nozzle plate 11. The respective nozzle holes 12 are formed at positions corresponding to opening surfaces of the ink chambers in the actuator units 20 through 90.

As described above, according to the head 10 of the embodiment of the invention, the drive electrodes 23 of the respective actuator units 20 through 90 are connected to the output side electrodes 28 on the projected portions 31A of the cover plates at the contiguous actuator units, and are electrically connected to the driver IC chips 25 at these portions.

According to the above-described structure, the respective actuator units can be laminated and integrated since no FPCs are interposed -among the respective actuator units 20 through 90.

Accordingly, the size of the head in the laminating direction can be decreased, compared with the conventional head where FPCs are interposed among the respective actuator units.

Figure 11:
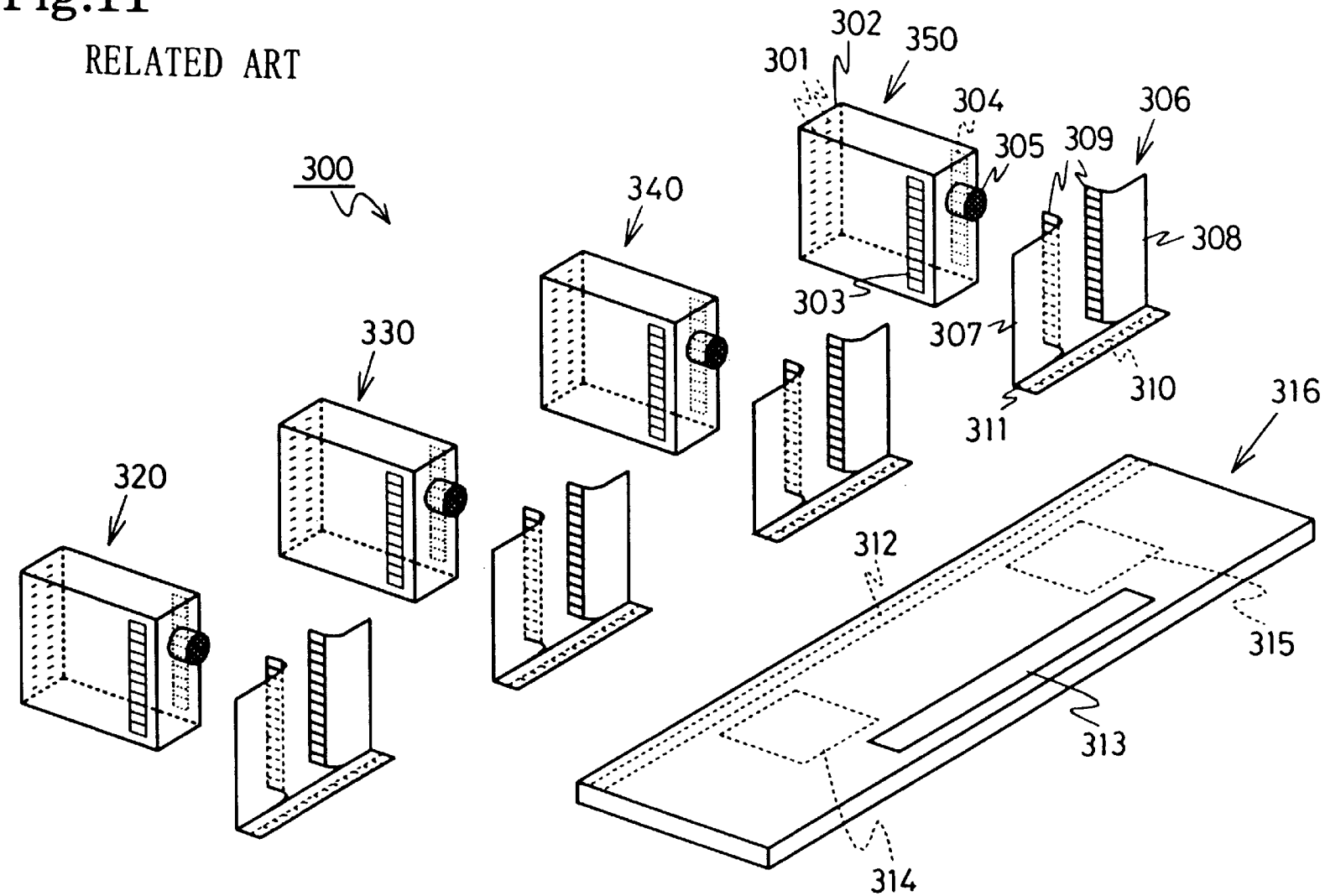
Fig.11 RELATED ART
FIG. 11 is an exploded perspective view of a head in accordance with the related art.

According to measurements taken by the inventors, the size of the conventional head shown in FIG. 11, is 58 mm (width of head in laminating direction)×35 mm (depth from end face of nozzle plate to external end face of driver IC chip mounting base)×20 mm (height from lower face of driver IC chip mounting base to upper face of head). However, according to the head of the embodiment of the invention, H×D×W shown in FIG. 1 is 32 mm×20 mm×18 mm. The measurements show that considerable miniaturization of the head can be accomplished.

Furthermore, by laminating the respective actuator units 20 through 90 by aligning their front ends, the front surface (nozzle attaching surface) of the head 10 can be made flush with high accuracy.

Therefore, it is not necessary to position the nozzle surface on the control base for each of the heads as with the conventional heads. Therefore, the time required for positioning is shortened and the manufacturing efficiency of the head is promoted.

Furthermore, as shown in FIG. 1, the respective actuator units 20 through 90 are integrated. Therefore, only one sheet of the nozzle plate 11 is attached thereto.

Accordingly, the manufacturing efficiency of the head is further promoted by shortening the time period required for attaching the nozzle plate, as compared with a conventional head where a nozzle plate is attached to each head.

When the drive electrodes 23 are extended onto the projected portion 31A via the upper surface of the base plate 22, which is different from the structure of the embodiment of the invention, the ink chambers 24 are open at the upper surface of the base plate 22. Therefore, to extend the drive electrodes 23 to the projected portion 31A, the drive electrodes 23 must extend only on the separating walls 22A, which is far narrower than the rear face 21D of the base plate 21. It is very difficult to accurately form the drive electrodes on only the narrow separating walls 22A. According to the structure where the drive electrodes 23 are extended onto the projected portion 31A via the upper surface of the base plate 22 in this manner, a pattern for extending the drive electrodes 23 and a direction of extending thereof are restricted. However, according to the embodiment of the invention, the drive electrodes 23 are extended onto the projected portion 31A via the bottom surface 22D of the wide base plate 22. Therefore, the drive electrodes 23 can easily be formed extending to the projected portion 31A.

Furthermore, the cover plate is formed of a ceramic substrate. Accordingly, the actuator unit having sufficient rigidity and ink corrosion resistance can be achieved. Further, forming the drive electrodes onto the projected portion and mounting the drive circuit can easily be accomplished.

Further, according to the heads of the above-described related art, even if the positions of attaching the respective heads to the control base are slightly deviated leftwardly, rightwardly, upperwardly, or downwardly (directions orthogonal the direction of jetting ink droplets), dispersion is caused in the arrival direction or the arrival distance of ink droplets to the record medium, which deteriorates print quality. However, according to the head of the embodiment of the invention, the surface for attaching nozzles of the respective heads can be aligned highly accurately as described above. Therefore, high print quality can be realized by preventing dispersion in the arrival direction or the arrival distance of ink droplets to the recording medium from occurring.

Incidentally, according to the embodiment of the invention, the actuator unit 20 corresponds to a first actuator unit of the invention, and the actuator unit 30 corresponds to a second actuator unit of the invention.

Further, although according to the embodiment of the invention, each cover plate is projected in the rearward direction from the surface bonded with the base plate, the cover plate may be projected from the surface bonded with the base plate in a side direction. Also, the driver IC chip may be embedded into a cover plate of a ceramic substrate.

Next, an explanation will be given of an ink jet printer (hereafter, referred to as printer) having an ink jet head of the embodiment of the invention shown in FIGS. 9 and 10.

Figure 9:
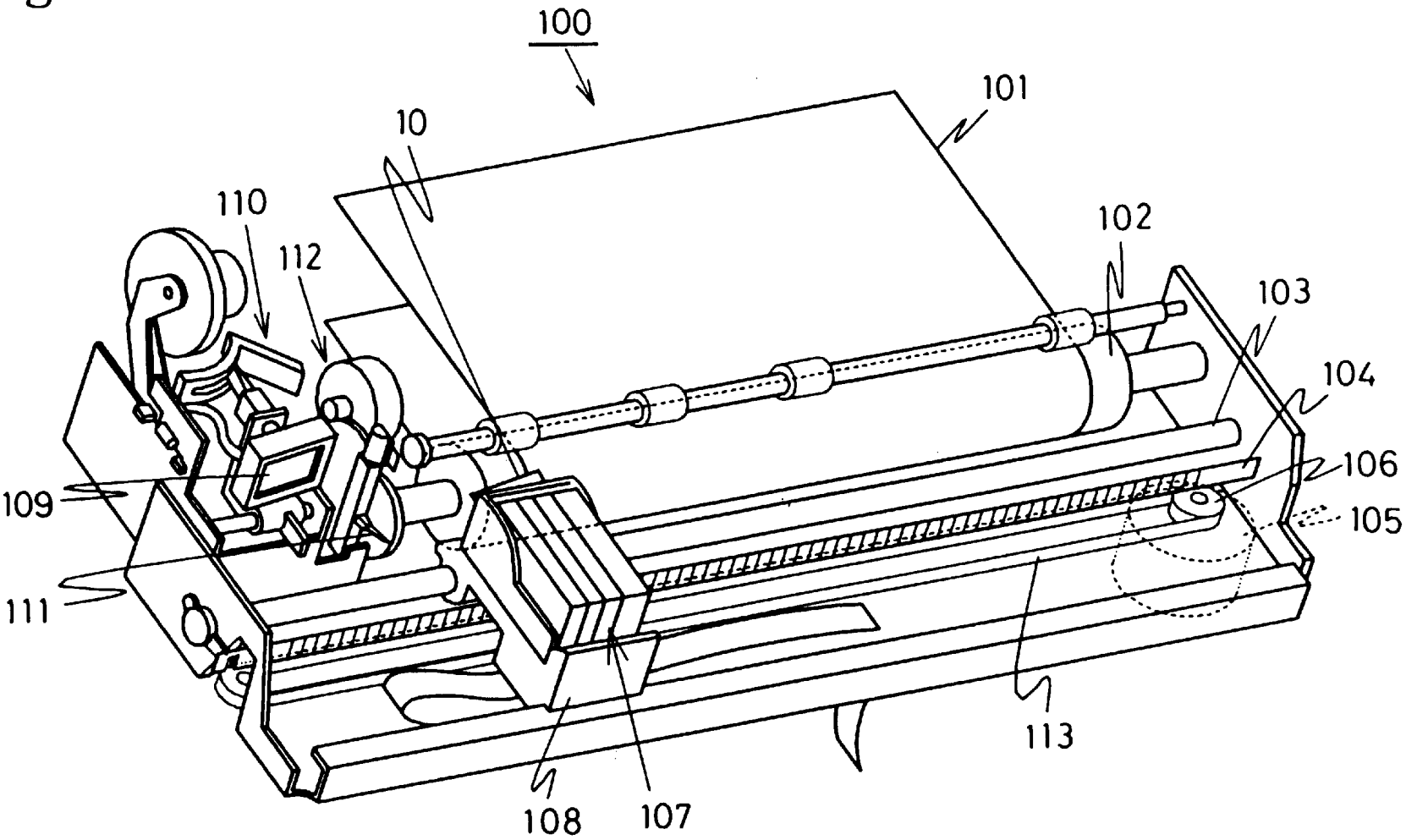
FIG. 9 is a perspective view showing the essential structure of a printer.

FIG. 9 is a perspective view showing the essential structure of the printer. FIG. 10 is a block diagram showing the structure of a control system of the printer shown in FIG. 9.

Figure 10:
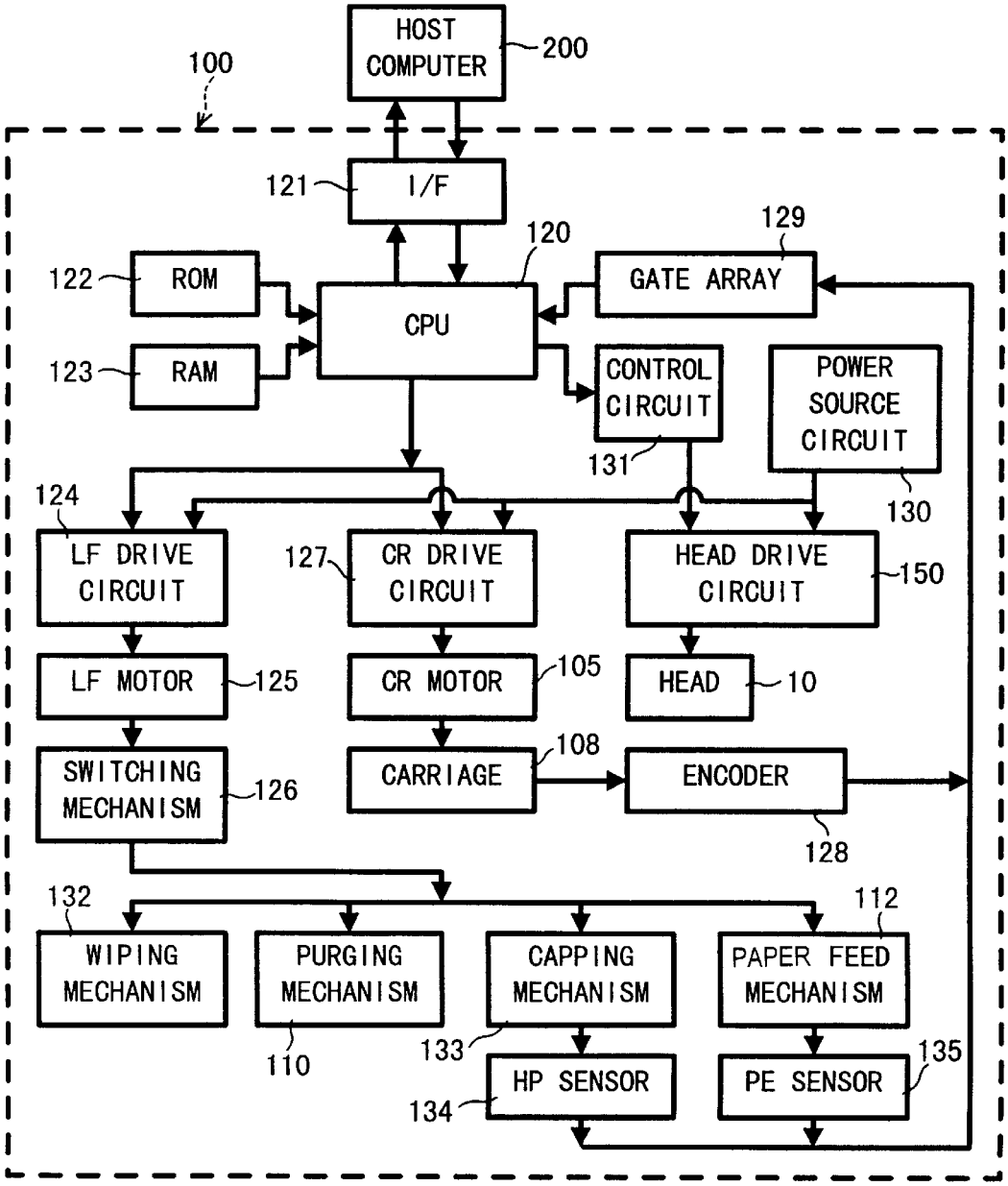
FIG. 10 is a block diagram showing the structure of a control system of the printer shown in FIG. 9.

A printer 100 is provided with a platen 102 to which print paper 101 is charged and the platen 102 is rotated by a paper feed mechanism 112 connected to an LF motor (line feed motor) 125 (refer to FIG. 10). A head 10 is installed at a position opposing the platen 102. The head 10 is provided with an ink cartridge 107 for supplying the head 10 with ink. The head 10 and the ink cartridge 107 are mounted on a carriage 108. A guide shaft 103 attached to the printer 100 in the width direction is slidably inserted through the front rear portion of the carriage 108.

Further, an endless belt 113 hung on a pulley 106 of a CR motor (carriage return motor) 105 is connected to the carriage 108.

That is, the head 10 is reciprocated on the guide shaft 103 opposite to the platen 102 by rotating the CR motor 105. Further, the head 10, the LF motor 125 and the CR motor 105 are driven by a power source supplied from a power source circuit 130 (refer to FIG. 10).

Linear type timing slits 104 are provided below the guide shaft 103 along therewith. A sensor element outputting pulse signals corresponding to the position of the carriage 108 by reading intervals of slits provided on the timing slits 104, is installed at the lower portion of the front surface of the carriage 108. An encoder 128 includes the timing slits 104 and the sensor element (refer to FIG. 10).

The printer 100 is provided with a flushing function for maintaining an excellent printing state by periodically jetting failed ink including air bubbles to an ink absorber. Further, the printer 100 is provided with a purging mechanism 110 for effectively maintaining an jetting state of ink by sucking periodically dried ink or foreign objects clogged in nozzles. A suction cap 109 for capping the head 10 for carrying out purging operation is installed on the left side in the moving direction of the head 10.

Further, the printer 100 is provided with a capping mechanism 133 (refer to FIG. 10) for capping via the suction cap 109 a surface of the head 10 where nozzles are formed when the head 10 is not used for a time in excess of a specified period. Also, the printer 100 is provided with a wiping mechanism 132 (refer to FIG. 10) for wiping to clean ink adhered to the surface of the head 10 where nozzles are formed. A wiper member 111 is installed on the right side of the suction cap 109.

Next, an explanation will be given of the essential structure of a control system of the printer 100 with reference to FIG. 10.

The printer 100 is provided with CPU 120 for performing various calculation processings, described below. An interface 121 for receiving signals of print data outputted from a host computer 200 and a control circuit 131 for controlling a head drive circuit 150 are connected to CPU 120. Further, ROM 122 and RAM 123 for storing printing programs for carrying out printing operation by driving the head 10, and a gate array 129 for calculating the position of the carriage 108 by inputting encoder signals outputted from an encoder 128, are connected thereto.

CPU 120 stores print data received from the host computer 200 via the interface 121 to predetermined regions of RAM 123 and outputs various control signals for driving the LF motor 125, the CR motor 105 and the head 10 in accordance with the printing programs previously stored in RAM 122.

Among the control signals, an LF motor driving control signal for driving the LF motor 125 is inputted to an LF drive circuit 124. The LF motor 125 is driven in accordance with the LF motor drive signal outputted from the LF drive circuit 124. That is, by driving the LF motor 125, the print paper 101 is fed in the longitudinal direction.

Also, the wiping mechanism 132, the purging mechanism 110 and the capping mechanism 133 are driven by the LF motor 125 respectively via a switching mechanism 126. Also, among the control signals, a CR motor driving control signal for driving the CR motor 105, is inputted to a CR drive circuit 127 and the CR motor 105 is driven in accordance with the CR motor drive signal outputted from the CR drive circuit 127. The carriage 108 is reciprocated by driving the CR motor 105 and the position of the carriage 108 is detected by the encoder 128.

The encoder signal outputted from encoder 128 is inputted to the gate array 129. The gate array 129 generates speed data signals of the carriage 108, pulses for controlling the position of the carriage 108 (reference pulse), and print timing pulses for driving the head 10 based on the inputted encoder signal.

CPU 120 calculates a PWM signal (pulse width of drive signal of CR motor 105) that is necessary for controlling the speed of the carriage 108 by inputting the speed data (time interval value between respective edges of encoder signals) outputted from the gate array 129. Further, CPU 120 calculates a current position of the carriage 108 by inputting the position controlling pulses (reference pulse). Also, CPU 120 carries out control operations for writing the delay count value for aligning print position when the print direction is reversed or data for permitting a print start signal in a register of the gate array 129.

Furthermore, CPU 120 counts an amount of feeding print paper, counts an amount of rotating cams for driving the purging mechanism 110 or the capping mechanism 133 executed by the LF motor 125 and the paper feed mechanism 112, by counting pulse signals which are driving signals of the LF motor 125. The capping mechanism 133 is provided with an HP (home position) sensor 134 for detecting that the carriage 108 returns to the capping position (home position) and the paper feed mechanism 112 is provided with a PE (paper empty) sensor 135 for detecting discharge of paper, respectively.

In this way, according to the printer 100, the carriage 108 can be miniaturized since the carriage 108 is provided with the head 10 of the embodiment of the invention. Furthermore, high quality printing can be carried out since no dispersion is caused in the characteristic of jetting ink droplets because the surfaces of the respective actuator units of the head 10 are accurately positioned to be flush with each other.

Although an explanation has been given of the embodiments with respect to the structure where the head is applied to a color ink jet printer, the invention can preferably be used in an ink jet printer of a thermoelectric conversion type such as a bubble jet printer, a thermal ink jet printer or similar device.

Also, although the base plate 22 includes piezoelectric elements in the above-described embodiments, only displacing portions of the separating walls 22A where the drive electrodes 23 are provided may be formed by piezoelectric elements.

It is to be understood that the invention is not restricted to the particular forms shown in the foregoing embodiment. Various modifications and alternations can be made thereto without departing from the scope of the invention encompassed by the appended claims.

What is claimed is:

1. An ink jet head for use with a drive circuit, comprising:

a plurality of actuator units including at least a first actuator unit and a second actuator unit which are laminated, each of said plurality of actuator units including:

a base plate having a first surface and a second surface opposite the first surface, the base plate defining a plurality of ink chambers at the first surface;

a cover plate disposed on the base plate to cover the plurality of ink chambers;

a plurality of drive electrodes formed on side surfaces of each of said plurality of ink chambers;

a plurality of extended electrodes extending from said plurality of drive electrodes and which are formed on the second surface of said base plate; and a plurality of connecting electrodes disposed on said cover plate that connect said plurality of extended electrodes and the drive circuit;

wherein said extended electrodes formed on the second surface of said base plate of the first actuator unit are connected to said plurality of connecting electrodes disposed on said cover plate of the second actuator unit.

2. The ink jet head according to claim 1, further comprising:

a projected portion extending from said cover plate and projecting from an end surface of said base plate;

wherein the drive circuit and said plurality of connecting electrodes are formed on said projected portion.

3. The ink jet head according to claim 2, wherein said cover plate includes a ceramic substrate.

4. The ink jet head according to claim 2, further comprising:

a nozzle plate that includes a single sheet which defines a plurality of nozzle holes at positions corresponding to an end portion of each of the respective ink chambers, and that is attached to an end surface of the ink jet head.

5. The ink jet head according to claim 1, wherein said base plate includes a piezoelectric element.

6. The ink jet head according to claim 1, wherein the base plate defines a plurality of slits, each of said plurality of slits communicating with each of the ink chambers.

7. The ink jet head according to claim 6, wherein said plurality of extended electrodes are also provided on surfaces of said plurality of slits.

8. A method of manufacturing an ink jet head that includes a plurality of actuator units including at least a first actuator unit and a second actuator unit which are laminated, comprising the steps of:

providing a base plate having a first surface and a second surface opposite the first surface, the base plate defining a plurality of ink chambers at the first surface;

covering the plurality of ink chambers with a cover plate;

forming a plurality of drive electrodes on side surfaces of each of the plurality of ink chambers;

forming a plurality of extended electrodes on the second surface of the base plate, the plurality of extended electrodes extending from said plurality of drive electrodes; and forming a plurality of connecting electrodes on the cover plate such that the connecting electrodes connect the plurality of extended electrodes and a drive circuit;

wherein the extended electrodes formed on the second surface of the base plate of the first actuator unit are connected to the plurality of connecting electrodes disposed on the cover plate of the second actuator unit.

9. The method according to claim 8, further comprising the step of forming the drive circuit and said plurality of connecting electrodes on a projected portion which extends from said cover plate and projects from an end surface of said base plate.

10. The method according to claim 9, further comprising the step of forming the cover plate of ceramic substrate.

11. The method according to claim 9, further comprising the step of attaching a nozzle plate, that includes a single sheet which defines a plurality of nozzle holes at positions corresponding to an end portion of each of the respective ink chambers, to an end surface of the ink jet head.

12. The method according to claim 8, further comprising the step of forming the base plate of a piezoelectric element.

13. The method according to claim 8, further comprising the step of forming the base plate to define a plurality of slits, each of said plurality of slits communicating with each of the ink chambers.

14. The method according to claim 13, further comprising the step of forming said plurality of extended electrodes on surfaces of said plurality of slits.

15. An ink jet head for use with a drive circuit, comprising:

a plurality of actuator units including at least a first actuator unit and a second actuator unit which are laminated, each of the plurality of actuator units including:

means for defining a plurality of ink chambers having a bottom surface;

means for covering the plurality of ink chambers;

means for applying drive voltages to side surfaces of the plurality of ink chambers;

means for extending the means for applying drive voltages along the bottom surface of the means for defining the plurality of ink chambers; and means for connecting the means for extending the means for applying drive voltages to the drive circuit, the means for connecting disposed on the means for covering the plurality of ink chambers;

wherein the means for extending the means for applying drive voltages of the first actuator unit is connected to the means for connecting the means for extending the means for applying drive voltages disposed on the means for covering the plurality of ink chambers of the second actuator unit.

16. The ink jet head according to claim 15, further comprising:

a projected portion extending from said means for covering and projecting from an end surface of the means for defining;

wherein the drive circuit and said means for connecting are formed on said projected portion.

17. The ink jet head according to claim 16, wherein the means for covering includes a ceramic substrate.

18. The ink jet head according to claim 16, further comprising:

a nozzle plate that includes a single sheet which defines a plurality of nozzle holes at positions corresponding to an end portion of each of the respective ink chambers, and that is attached to an end surface of the ink jet head.

19. The ink jet head according to claim 15, wherein the means for defining the plurality of ink chambers includes a piezoelectric element.

20. The ink jet head according to claim 15, wherein the means for defining the plurality of ink chambers defines a plurality of slits, each of said plurality of slits communicating with each of the ink chambers.

21. The ink jet head according to claim 20, wherein the means for extending the means for applying drive voltages are also provided on surfaces of said plurality of slits.

* * * * *